US005727250A

United States Patent [19]

Black

[11] Patent Number: 5,727,250

[45] Date of Patent: Mar. 17, 1998

[54] SUNSHADE FOR HARD HAT

[76] Inventor: Randolph Black, 60 Highland Ave., Sumter, S.C. 29150

[21] Appl. No.: 781,684

[22] Filed: Jan. 10, 1997

[51] Int. Cl.[6] ..... A42B 3/04

[52] U.S. Cl. ..... 2/10; 2/171; 2/183; 2/209.3

[58] Field of Search ..... 2/10, 12, 15, 171, 2/171.1, 175.1, 175.2, 181, 183, 209.3, 209.4

[56] References Cited

U.S. PATENT DOCUMENTS

| | | | |
|---|---|---|---|
| 128,780 | 7/1872 | Battle . | |
| 317,972 | 5/1885 | Cary . | |
| 540,524 | 6/1895 | Wardwell . | |
| 819,324 | 5/1906 | Thratt . | |
| 986,728 | 3/1911 | Lee | 2/12 |
| 1,030,173 | 6/1912 | Haggerty . | |
| 1,283,357 | 10/1918 | Thompson | 2/209.3 |
| 1,560,073 | 11/1925 | Bontempi et al. . | |
| 1,587,681 | 6/1926 | Schumacher . | |
| 1,706,205 | 3/1929 | Alonzo . | |
| 2,728,913 | 1/1956 | Connor . | |
| 2,882,894 | 4/1959 | Fahey et al. . | |
| 2,934,767 | 5/1960 | Schoener . | |
| 4,316,289 | 2/1982 | Hild | 2/10 |
| 4,547,908 | 10/1985 | Karlsson et al. . | |
| 5,406,645 | 4/1995 | Lin | 2/10 |

FOREIGN PATENT DOCUMENTS

| | | | |
|---|---|---|---|
| 321483 | 1/1903 | France . | |
| 287482 | 4/1915 | Germany . | |
| 644095 | 4/1937 | Germany | 2/12 |
| 1826 | of 1869 | United Kingdom . | |
| 25101 | of 1897 | United Kingdom . | |

*Primary Examiner*—Diana Biefeld

[57] ABSTRACT

A sunshade for use with a hard hat to provide shade and ultraviolet protection for the wearer comprises a vinyl disk with a hole dimensioned to receive the crown of a hard hat, the disk being covered with a washable fabric and having an elastic band sewn to the covering at the hole. The diameter of the elastic band is smaller than the diameter of the hole so that, at the point of attachment to the covering, the band is stretched radially outward and defines thereby a first portion of the band on one side of the disk and a second portion on the opposing side. The first portion grips the crown of the hard hat above the brim and the second portion wraps around the underside of the brim. The sunshade typically ranges in size from at least 16 inches to 20 inches in diameter.

20 Claims, 2 Drawing Sheets

Fig 1 – PRIOR ART
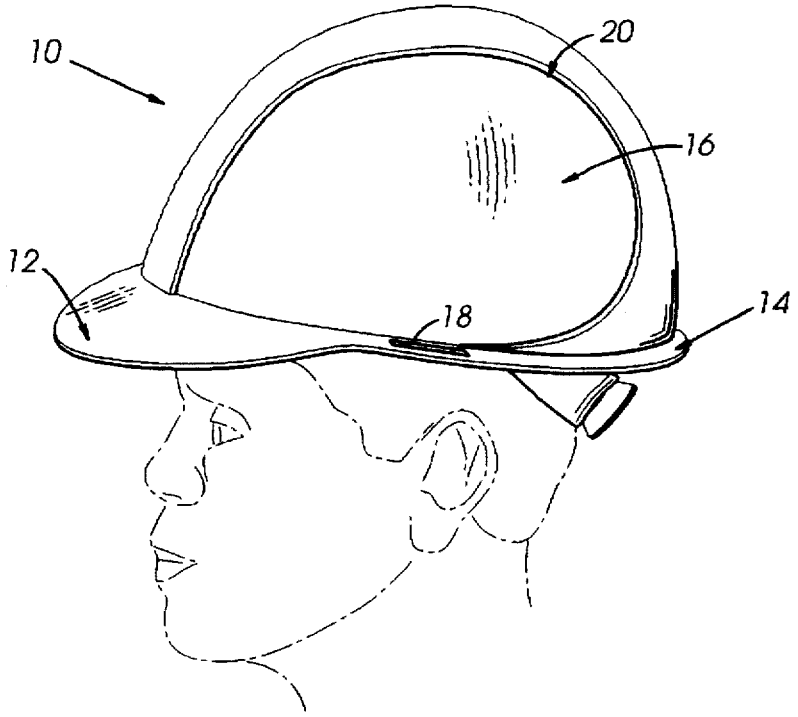
Fig 2
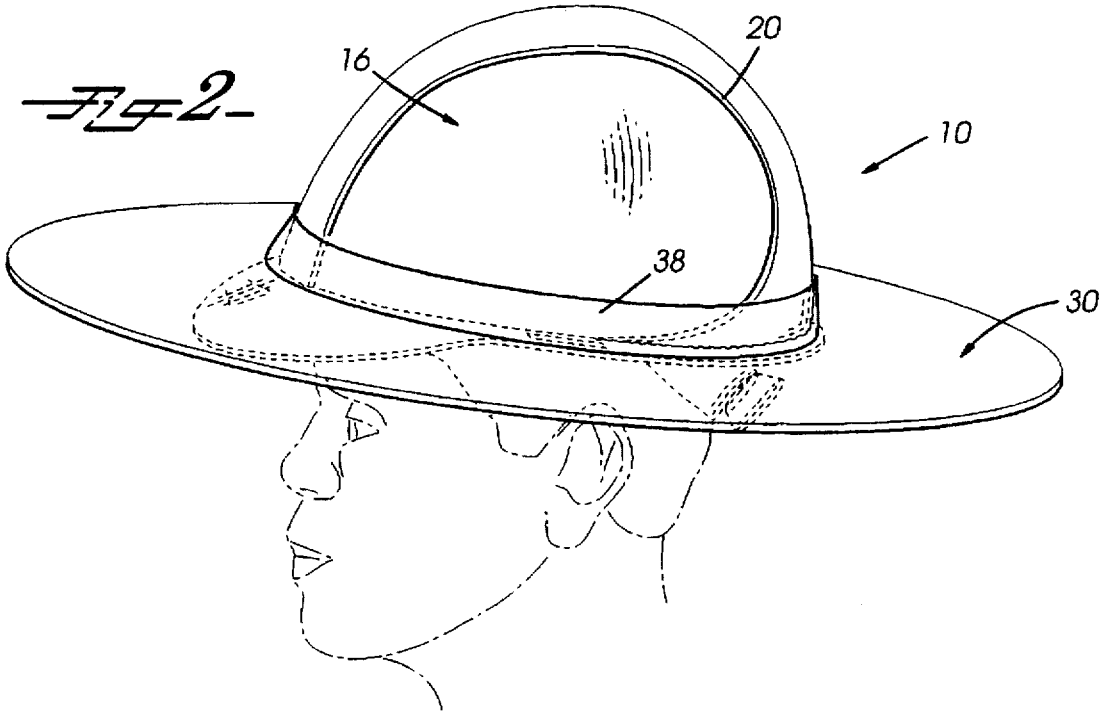

SUNSHADE FOR HARD HAT

BACKGROUND OF THE INVENTION

1. Field of the Invention

The present invention relates to hats. In particular, the present invention relates to a covering for a hard hat to shield the wearer of the hard hat from the sun and in particular from ultraviolet light.

2. Discussion of Background

Construction workers are required by law and good sense to wear what is called a "hard hat." A hard hat is a rigid plastic hat that is designed to avoid serious injury in the event an object falls on the worker's head or the worker bumps his head. Even when working outdoors in the sun, the worker is required to wear the hard hat.

There are two standard designs for hard hats and several variations of the surface features (or "ribs") which add rigidity to the hat; however, all hard hats have the same overall shape. On the inside, there is an adjustable sweatband that allows each worker to customize a hard hat to fit his or her head. Each hard hat has a slot for a chin strap on each side at the base of the crown of the hat, and some hard hats also have ribs that extend from the top of the hat to the base of the crown as well.

One feature absent from the standard hard hat is a large brim. On some hard hats, there is a short brim around the sides and back and a slightly larger brim on the front; in the back of these hard hats in particular, the brim only extends down to the top of the neck. Other hard hats have a slightly larger and more uniform brim. However, in neither version is the brim large enough to afford protection for the worker's neck or face from the sun's heat, glare and its ultraviolet rays.

SUMMARY OF THE INVENTION

According to its major aspects and briefly stated, the present invention is a sunshade that fits over a standard hard hat. The sunshade comprises a disk, a covering for the disk, and a means for securing the covered disk to the hard hat. The covering is preferably a washable fabric.

The securing means is, in a preferred embodiment, a wide elastic band that is sewn to the covering of the sunshade. The band, which is in the form of a cylinder, has a diameter somewhat smaller than the hole in the disk. The band is then sewn to the brim somewhere between the band's extreme edges, stretching the band radially outwardly at its point of attachment to the covering. Part of the band is above the brim and engages the crown; the other part of the band wraps around the brim.

A feature of the present invention is that it is a sunshade that can be added to any existing hard hat. Because it simply fits on a hard hat, a worker does not need to carry two different hard hats, one for sunny days and a second hat for cloudy days; the worker simply puts the present sunshade over the hard hat being worn when he wants protection from the sun. Second, because the worker is wearing a hard hat with the sunshade on it, he is in full conformance with safety requirements mandating hard hats be worn at construction sites.

Another important feature of the present invention is the elastic band. It not only secures the hard hat from slipping out of the brim, but it accommodates different types and sizes of hard hats easily without adjustment and is easily attached to the brim by sewing for example.

Still another feature of the present invention is that the generous brim of the sunshade blocks ultraviolet light, which is known to cause skin cancer, and it makes the worker more comfortable and productive.

Other features and advantages of the present invention will be apparent to those skilled in the art from a careful reading of the Detailed Description of Preferred Embodiments accompanied by the Drawings.

BRIEF DESCRIPTION OF THE DRAWINGS

In the drawings,

FIG. 1 is a perspective view of a hard hat according to the prior art;

FIG. 2 is a perspective view of the upper side of a hard hat with a sunshade according to a preferred embodiment of the present invention;

DETAILED DESCRIPTION OF PREFERRED EMBODIMENTS

Figure 3:
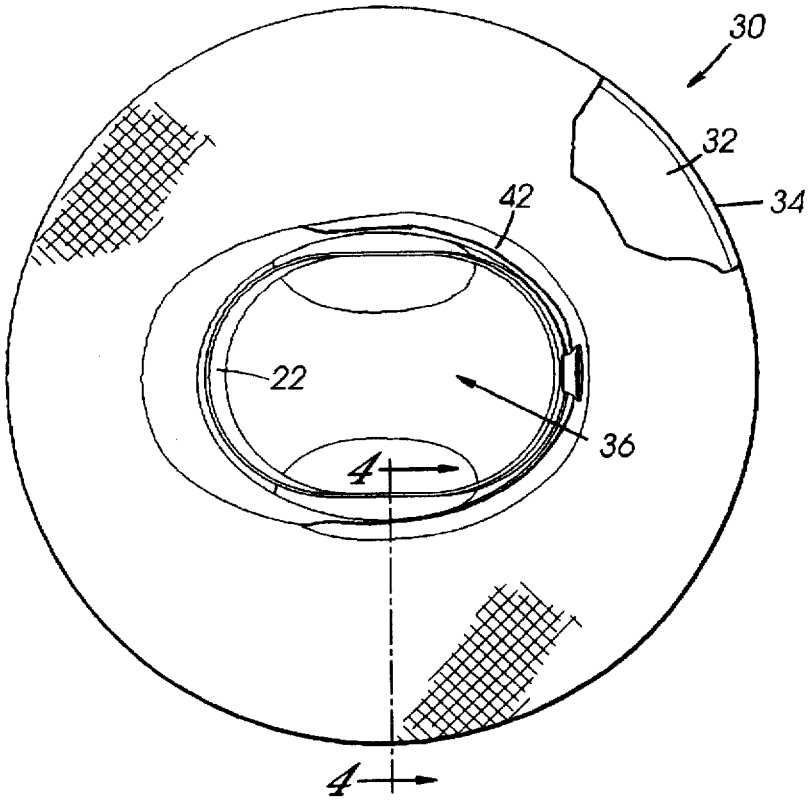
FIG. 3 is a bottom view of a hard hat with a sunshade according to a preferred embodiment of the present invention.
Figure 4:
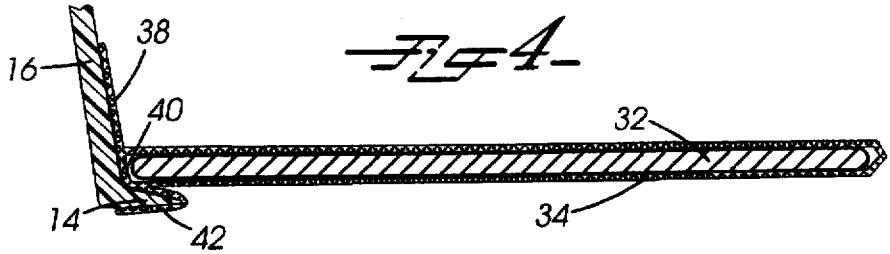
FIG. 4 is a detailed cross-sectional view of a sunshade on a short brim hard hat according to a preferred embodiment of the present invention.
Figure 5:
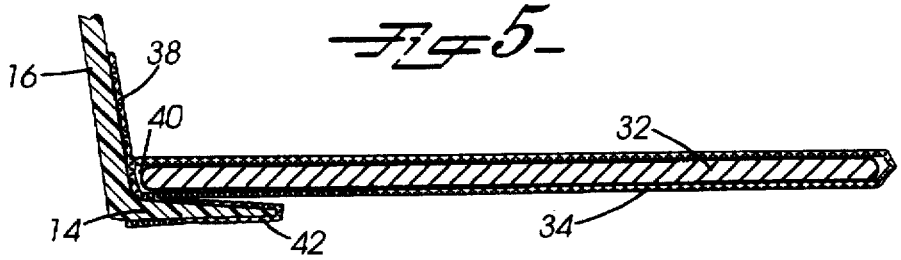
FIG. 5 is a detailed cross-sectional view of a sunshade on a larger brim hard hat according to a preferred embodiment of the present invention.

The present invention is a sunshade for use with a hard hat. The sunshade is, broadly speaking, a generally circular or oval disk with a hole in the center dimensioned for receiving the crown of the hard hat; that is, the hard hat fits into the hole until the crown is all the way through the hole, but the brim is not. The disk is preferably at least 16 inches in diameter and preferably not more than about 20 inches in diameter. It is either a washable plastic, such as polyethylene, or a plastic covered in a removable, washable fabric, such as vinyl, cotton or cotton blend. With the fabric, the sunshade will range from approximately 16½ inches to 20½ inches in diameter.

FIG. 1 illustrates a standard hard hat in perspective. The hard hat shown, indicated by the reference numeral 10 has a short beak 12 and an even shorter, upwardly curved brim 14. Hat 10 has a crown 16 with a chin strap slot 18 on each side (the right side only showing in FIG. 1). Ribs 20 add rigidity to crown 16. Inside of crown 16 is a sweatband 22 (see FIG. 3). An alternative style of hard hat has a smooth oval crown and a larger brim to the front and back, but the brim is still too small to offer meaningful protection from the sun. The present sunshade will fit on either basic style and on any other style as long as the crown of the hard hat fits into the hole in the sunshade.

FIGS. 2 and 3 illustrate the standard hard hat of FIG. 1 with a sunshade 30 according to a preferred embodiment of the present invention placed on it. Sunshade 30 sits on brim 14 and beak 12 and extends laterally from hat 10 by a sufficient margin to provide meaningful shade for the wearer's neck, ears, and face.

As illustrated in FIGS. 2–5, sunshade 30 includes a disk 32 and a covering 34. Disk 32 has a hole 36 dimensioned and shaped to receive the crown 16 of a hard hat 10. Hole may be generally oval and may optionally have cut out portions to accommodate details in the shape of the hard hat's crown 16 for a snugger fit. Disk 32 is made of unbreakable, but flexible and resilient material such as a plastic. Covering 34, preferably a simple, washable polyester, cotton, cotton/polyester blend or vinyl material, covers disk 32.

Sunshade 30 also has means for securing disk 32 and covering 34 to hard hat 10. This securing means holds hard hat 10 in hole 36, but a releasable manner. As illustrated, the securing means is an elastic band 38 sewn or otherwise attached to covering 34 near the perimeter of hole 36. Importantly, the securement must be quick and easy to effect, but must also provide sufficient holding strength to keep sunshade 30 from slipping off hard hat 10 in normal use. Although the securing means can include some form of hook-and-loop fastener, peelable adhesives, snaps and the like, elastic band 38 is preferred because it requires no modification of hard hat 10 and is simply pulled onto hard hat 10 to secure sunshade 30 to hard hat 10. It also locks onto the short brimmed hard hat in a manner that will be described below. Elastic band 38 may be of any type material having natural or manmade rubber threads woven among fiber threads or may be made of solid rubber. The choice would be based in part on wear characteristics, including effects of washing and exposure to sunlight, and in part on cost of fabrication.

Band 38 is in the shape of a cylinder having a circumference slightly smaller than that of hole 36 so that, when attached to covering 34, band 38 must be stretched radially outward at the point of attachment and, above the point of attachment to covering 34, a first portion 40 of band 38 elastically grips crown 16 of hard hat 10. A second portion 42 of band 38 to the other side of disk 32, below the point of attachment, can be pulled down, in the direction opposite that of the other part that engages crown 16, so that it wraps elastically around brim 14 of hard hat 10. By doing so, band 38 then prevents sunshade 30 from riding up and off hard hat 10. Thus, if band 38 is made wide enough, and if it is sewn (or secured in some other permanent way) to covering 34 somewhere between its extreme edges, then there will be a portion above the point of attachment to covering 34 that secures sunshade 30 to hard hat 10 by gripping crown 16 elastically and a portion below the point of attachment that secures sunshade 30 to hard hat 10 by wrapping around brim 14. This dual engagement holds sunshade 30 firmly to hard hat 10. It will of course be clear that band 38 may actually be two separate bands, one attached to the top of covering 34 instead of first portion 40 and the other attached to the bottom of covering, instead of second portion 42 of one continuous band 38.

It will be apparent to those skilled in the art that many other modifications and substitutions can be made to the preferred embodiment just described without departing from the spirit and scope of the invention as defined in the appended claims.

What is claimed is:

1. A sunshade for use with a hard hat, said hard hat having a brim and a crown, said sunshade comprising:

a disk having a hole formed therein dimensioned to receive the hard hat;

an elastic band secured to said disk and adapted to hold said disk to the hard hat when the crown of the hard hat is inserted into said hole; and a covering over said disk and to which said elastic band is sewn.

2. The sunshade as recited in claim 1, wherein said sunshade further comprises a covering over said disk and to which said elastic band is attached.

3. The sunshade as recited in claim 1, wherein said sunshade further comprises a washable covering over said disk.

4. The sunshade as recited in claim 1, wherein said elastic band is attached to said disk so that a first portion of said band is on one side of said disk and a second portion of said band is on the opposing side of said disk.

5. The sunshade as recited in claim 1, wherein said sunshade further comprises a covering over said disk to which said elastic band is attached, and wherein said elastic band is attached to said covering so that a first portion of said band is on one side of said disk and a second portion of said band is on the opposing side of said disk.

6. The sunshade as recited in claim 1, wherein said elastic band is sewn to said covering at said hole.

7. A sunshade for use with a hard hat, said hard hat having a brim and a crown, said sunshade comprising:

a disk having a hole formed therein dimensioned to receive the hard hat;

a covering for said disk; and an elastic band sewn to said covering at said hole to secure disk to said hard hat when crown of hat is inserted into said hole.

8. The sunshade as recited in claim 7, wherein said covering is made of a material selected from the group consisting of vinyl, cotton, polyester, and cotton/polyester blends.

9. The sunshade as recited in claim 7, wherein said disk is made of plastic.

10. The sunshade as recited in claim 7, wherein said securing means is an elastic band attached to said covering at said hole.

11. The sunshade as recited in claim 7, wherein said elastic band is sewn so that a first portion is on one side of said disk and a second portion of said band is on the opposing side of said disk.

12. The sunshade as recited in claim 7, wherein said elastic band has a diameter smaller than said hole, said band being sewn to said covering so that said band is stretched radially outwardly at the point of attachment.

13. The sunshade as recited in claim 7, wherein said elastic band has a diameter smaller than said hole and is sewn to said covering so that said band is stretched radially outwardly at the point of attachment and so that a first portion is on one side of said disk and a second portion of said band is on the opposing side of said disk.

14. A sunshade for use with a hard hat, said hard hat having a brim and a crown, said sunshade comprising:

a disk having a hole formed therein dimensioned to receive the hard hat;

a covering for said disk; and an elastic band sewn to said covering at said hole to secure said disk to said hard hat when the crown of the hard hat is inserted into said hole.

15. The sunshade as recited in claim 14, wherein said covering is made of a material selected from the group consisting of vinyl, cotton, polyester, and cotton/polyester blends.

16. The sunshade as recited in claim 15, wherein said elastic band has a diameter smaller than said hole and is sewn to said covering so that said band is stretched radially outwardly at the point of attachment and so that a first portion is on one side of said disk and a second portion of said band is on the opposing side of said disk.

17. The sunshade as recited in claim 14, wherein said disk is made of plastic.

18. The sunshade as recited in claim 17, wherein said elastic band has a diameter smaller than said hole and is sewn to said covering so that said band is stretched radially outwardly at the point of attachment and so that a first portion is on one side of said disk and a second portion of said band is on the opposing side of said disk.

19. The sunshade as recited in claim 14, wherein said elastic band has a diameter smaller than said hole, said band being sewn to said covering so that said band is stretched radially outwardly at the point of attachment.

20. The sunshade as recited in claim 14, wherein said elastic band has a diameter smaller than said hole and is sewn to said covering so that said band is stretched radially outwardly at the point of attachment and so that a first portion is on one side of said disk and a second portion of said band is on the opposing side of said disk.

* * * * *